US011788285B2

(12) United States Patent
Lefranc et al.

(10) Patent No.: US 11,788,285 B2
(45) Date of Patent: Oct. 17, 2023

(54) RAIL FOR SUSPENDED CEILING COMPRISING EXPANSION ABSORBERS

(71) Applicant: SAINT-GOBAIN PLACO, Courbevoie (FR)

(72) Inventors: Maxime Lefranc, Sceaux (FR); Robin Czyzewicz, Downingtown, PA (US)

(73) Assignee: SAINT-GOBAIN PLACO, Courbevoie (FR)

( * ) Notice: Subject to any disclaimer, the term of this patent is extended or adjusted under 35 U.S.C. 154(b) by 0 days.

(21) Appl. No.: 17/913,681

(22) PCT Filed: Mar. 22, 2021

(86) PCT No.: PCT/FR2021/050481

§ 371 (c)(1),
(2) Date: Sep. 22, 2022

(87) PCT Pub. No.: WO2021/191545

PCT Pub. Date: Sep. 30, 2021

(65) Prior Publication Data

US 2023/0114856 A1 Apr. 13, 2023

(30) Foreign Application Priority Data

Mar. 23, 2020 (FR) ..... 2002817

(51) Int. Cl.
*E04B 9/08* (2006.01)
*E04B 9/06* (2006.01)

(52) U.S. Cl.
CPC ..... *E04B 9/08* (2013.01); *E04B 9/067* (2013.01)

(58) Field of Classification Search
CPC ..... E04B 9/08; E04B 9/067; E04B 9/068
See application file for complete search history.

(56) References Cited

U.S. PATENT DOCUMENTS 3,175,655 A * 3/1965 Brown ..... E04B 9/08 52/506.07
3,388,519 A * 6/1968 Downing, Jr. ..... E04B 9/068 52/777

(Continued)

FOREIGN PATENT DOCUMENTS

BE 903 188 A 3/1986
EP 1 167 649 A2 1/2002

(Continued)

OTHER PUBLICATIONS

Written Opinion of the International Searching Authority as issued in International Patent Application No. PCT/FR2021/050481, dated Jun. 22, 2021.

(Continued)

*Primary Examiner* — Rodney Mintz
(74) *Attorney, Agent, or Firm* — Pillsbury Winthrop Shaw Pittman LLP

(57) ABSTRACT

A novel design of rails for a suspended ceiling, the rails including expansion absorbers. The absorbers are produced so that the rails can absorb an expansion while maintaining the integrity of the ceiling, so that the ceiling panels do not fall in the event of a fire. The rails maintain a significant load-bearing capacity despite the presence of one or more expansion absorbers over the length thereof.

17 Claims, 3 Drawing Sheets

(56) References Cited

U.S. PATENT DOCUMENTS 3,390,503 A * 7/1968 Emerick, Jr. ..... E04B 9/122
52/506.07
3,397,501 A * 8/1968 Jahn ..... E04B 9/068
52/506.07
3,496,690 A * 2/1970 Jahn ..... E04B 9/064
52/506.07
3,589,089 A * 6/1971 Kedel ..... E04C 3/09
52/506.07
3,778,947 A * 12/1973 Sauer ..... E04B 9/067
403/252
3,846,031 A * 11/1974 Adams ..... E04B 9/122
52/506.07
3,965,631 A * 6/1976 Sauer ..... E04B 9/068
52/506.07
4,016,701 A * 4/1977 Beynon ..... E04B 9/08
52/506.07
4,106,878 A * 8/1978 Jones ..... E04B 9/14
52/664
4,128,978 A * 12/1978 Beynon ..... E04B 9/068
52/506.07
4,598,514 A * 7/1986 Shirey ..... E04B 9/068
52/DIG. 5
4,606,166 A * 8/1986 Platt ..... E04B 9/08
52/506.07
4,685,262 A * 8/1987 Meredith, Jr. ..... E04B 9/08
52/506.07
4,713,919 A * 12/1987 Platt ..... E04B 9/08
52/DIG. 5
4,785,595 A * 11/1988 Dunn ..... E04B 9/08
52/506.07
4,893,444 A 1/1990 Ollinger et al.
RE33,501 E * 12/1990 Platt ..... E04B 9/08
52/506.07
5,313,750 A * 5/1994 Frecska ..... E04B 9/068
52/573.1
5,347,783 A * 9/1994 Frecska ..... E04B 9/08
52/573.1
5,349,803 A 9/1994 Nute, Jr.
6,351,919 B1 * 3/2002 Lin ..... E04B 9/245
52/506.07

FOREIGN PATENT DOCUMENTS

EP 1 452 658 B1 9/2004
FR 2 704 016 A1 10/1994

OTHER PUBLICATIONS

International Search Report as issued in International Patent Application No. PCT/FR2021/050481, dated Jun. 22, 2021.

* cited by examiner

RAIL FOR SUSPENDED CEILING COMPRISING EXPANSION ABSORBERS

CROSS-REFERENCE TO RELATED APPLICATIONS

This application is the U.S. National Stage of PCT/FR2021/050481, filed Mar. 22, 2021, which in turn claims priority to French patent application number 2002817 filed Mar. 23, 2020. The content of these applications are incorporated herein by reference in their entireties.

The present invention relates to a novel design of rails for a suspended ceiling, comprising expansion absorbers.

Suspended ceilings are typically composed of panels supported by a rectangular grid of rails. The rails have an inverted T-shaped profile, comprising a vertical web, two arms of the T forming a base plate able to support the panels, and a bead at the upper part of the web. A decorative strip is positioned under the base plate and wrapped over the longitudinal edges of the base plate. The panels may be acoustic tiles. The suspended ceiling is typically supported by a rectangular grid of rails: long rails, referred to as main rails, arranged parallel to one another and resting, at the ends thereof, on corner pieces integral with the walls, constitute the primary structure of the grid. Shorter rails, referred to as cross rails, arranged parallel to one another but in the direction at right angles to the primary structure, connect the main rails to one another. The openings of the rectangular grid thus formed, the size of which is fixed by the length and spacing of the cross rails, are adapted to the size of the panels, which simply rest on the base plates of the rails.

This type of rail is well known, in particular from documents BE 903 188, EP 1 167 649 B1, EP 1 452 658 B1, U.S. Pat. Nos. 4,893,444, 5,349,803 and FR 2704016.

In the case of actual fire, or during fire certification tests, the rails, exposed to large temperature rises (+500° C. at 5 min, +650° C. at 10 min, +850° C. at 30 min and 950° C. at 60 min) expand and lengthen. Because the longest rails are generally fixed at their ends or abut against the walls, the expansion of these rails is blocked, which causes, as early as in the first few minutes of the fire, them to buckle out of the plane, distort in the plane, the tiles to fall and the fire insulation to be breached. In order to prevent these deformations and increase the fire stability of the acoustic ceiling, areas capable of absorbing the expansion are provided in the rails. These areas, or expansion absorbers, are rail portions with a specific geometry which are capable of deforming under the effect of the compressive force due to thermal expansion, and of thereby maintaining minimal distortion in the rail.

Document FR 2704016 describes a ceiling rail comprising an expansion section having a particular configuration. It consists of cut-outs and flat portions, offset over the two adjacent parts of the central rib and of the upper bead.

Document EP 1 167 649 describes expansion absorbers which each comprise two cut-outs, one in the bead, the other in the web.

One of the disadvantages of the expansion absorbers of the prior art is that they greatly weaken the load-bearing capacity of the rails, or they require stiffeners which greatly complicate the manufacture of the rails.

U.S. Pat. No. 4,893,444 describes a rail comprising an expansion absorber consisting of a large opening 40. The opening has a greater length than the height of the rail, which greatly reduces the load-bearing capacity of the rail. Moreover, during the expansion of the rail, the absorber causes a detachment, i.e. a loss of alignment of the profile.

Another disadvantage of the expansion absorbers of the prior art is that, subjected to compressive forces, their deformation sometimes occurs in an uncontrolled manner and this deformation destabilizes the tiles.

Commercially available rails generally comprise a single expansion absorber over the length thereof. Since the expansion of the rail may be approximately 5 mm/m (0.060 inch/foot), a single absorber must therefore absorb several centimeters of elongation. The occurrence of compressive deformations of a large amplitude located at a single point in the ceiling generates distortions in the rectangular grid and increases the risk of tiles falling.

The aim of the present invention is to provide ceiling rails which comprise at least one expansion absorber of a novel design, such that the rails can absorb an expansion whilst maintaining the integrity of the ceiling, so that the ceiling panels do not fall in the event of a fire.

In particular, one of the aims of the present invention is to provide ceiling rails which comprise a plurality of expansion absorbers.

One of the aims of the present invention is to provide rails that retain a significant load-bearing capacity despite the presence of one or more expansion absorbers over the length thereof.

One of the aims of the present invention is to provide rails which can comprise a plurality of expansion absorbers such that each of the absorbers absorbs part of the elongation of the rail and Therefore, the subject matter of the present invention is a rail for a panel support forming a suspended ceiling, said rail having an inverted T-shaped cross section and having a height Ht, the rail comprising:

a vertical web extending from a lower end to an upper end, horizontal extensions forming a base plate which is able to support the panels, which extensions are arranged at the lower end of the web, a bulbous piece arranged at the top of the web, said rail comprising at least one expansion absorber;

said expansion absorber comprising at least:

a main opening comprising 2 substantially vertical edges extending into the vertical web, the 2 edges being spaced apart by a length L1 when the rail is not subjected to a longitudinal compressive force, the 2 edges being aligned so as to abut against one another when the rail is subjected to a sufficient longitudinal compressive force;

said main opening extending, at the lower part, as far as an area of material able to form a fold line when the rail is subjected to a longitudinal compressive force;

two slits each extending on either side of the main opening over a total length L2 greater than L1, the two slits delimiting, with the base plate, two strips of material which are able to fold, the two substantially vertical edges extending over a height H1 representing between 0.3 and 0.8 times the height Hb of the web of the profiled element, preferably between 0.4 and 0.8 times the height Hb of the web.

According to a first embodiment of the rail according to the invention, the slits comprise a horizontal part and a vertical part. This thus delimits strips of material which are able to fold.

According to another embodiment of the rail, the slits extend obliquely from the base of the edges of the opening toward the areas able to form a fold line.

According to a certain embodiment, the opening extends, at the upper part thereof, to a fine strip of material which is able to deform under the effect of a longitudinal compressive force by forming a bridge.

In particular, this strip of material which is able to deform comprises a central notch defining a fold line in the upper part of the bulbous piece.

According to another embodiment, the upper part of the bulbous piece comprises a cut-out; the main opening extending, at the upper part thereof, to a segment of intact material present between the main opening and the cut-out of the bulbous piece; each segment of intact material of the bulbous piece being able to deform laterally under the effect of a longitudinal compressive force;

Advantageously, the web may comprise an extra thickness which stiffens the substantially vertical edges of the main opening.

Other extra thicknesses may be added, for example at the slits.

In particular, the ratio of the distances L2/L1 is greater than 2, preferably greater than 4.

The ratio of the distances L2/L3 is preferably between 4 and 9, even more preferably between 5 and 8.

In particular, the ratio L1/Ht is between 0.05 and 0.8, preferably between 0.1 and 0.5.

Advantageously, the two strips of material which are able to fold have a height H2, the ratio H2/Hb being between 0.02 and 0.4, preferably between 0.05 and 0.2.

In particular, the rail according to the invention may comprise a plurality of expansion absorbers arranged over the length thereof.

In a preferred embodiment of the present invention,

The invention will now be illustrated with reference to the figures, in which.

FIGS. 1 to 4 illustrate a rail 1 according to a first embodiment, the profile of which is an inverted T, comprising a central web 2 arranged vertically. At the lower end thereof, the arms of the T form a base plate 3 able to support ceiling panels (not shown). The upper part of the web has a bulbous piece 4 mounted over it. The profiled elements is produced at the outset from a metal plate or sheet of steel, in a single piece. The web 2 therefore consists of a double thickness of the starting plate.

Figure 1:
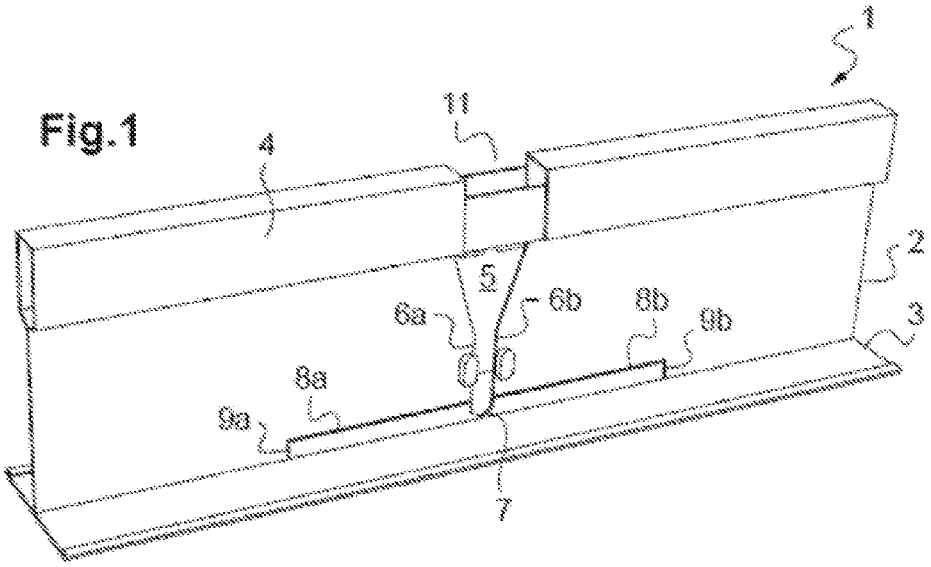
FIG. 1 shows a perspective view of part of a rail comprising an expansion absorber according to a first embodiment.
Figure 3:
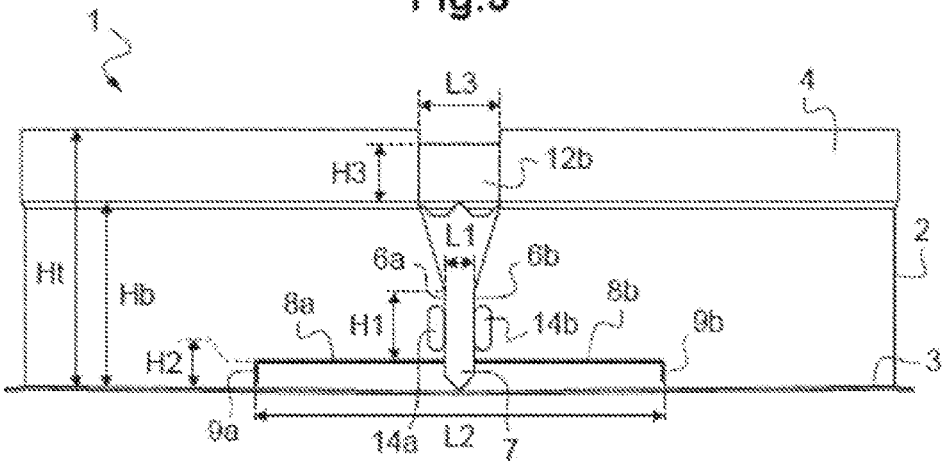
FIG. 3 shows a front view of the non-compressed rail.

An expansion absorber is illustrated in FIGS. 1 and 3. It consists of a main opening 5 made through the two thicknesses of the web 2. It extends, at the upper part thereof, substantially to the lower part of the bulbous piece 4 and, at the lower part thereof, to the base plate 3. The opening 5 comprises two vertical edges 6*a* and 6*b*, spaced apart by a distance L1. The opening delineates, at the lower part thereof, a V-shaped notch 7.

The expansion absorber further comprises two slits made in the two thicknesses of the web 2, on either side of the opening 5. In the example illustrated in FIGS. 1 to 4, the slits have a horizontal part 8*a*, 8*b* extending over a total distance L2 and a vertical part 9*a* and 9*b* connecting the distal end of the slit to the base plate 3. The remaining distance between the lower end of the vertical slits 9*a* and 9*b* and the base plate 3 is of the same order of magnitude as the thickness of the steel sheet constituting the rail.

The slits delimit, in the web 2, two strips of material 10*a* and 10*b* on either side of the notch 7 and above the base plate 3. The slits delimit, at the distal end thereof, a deflection point for the base plate when the rail is subjected to a longitudinal compressive force.

In a variant embodiment (not shown), the slits may extend obliquely from the main opening 5 to the base plate 3.

The expansion absorber further comprises a gap 11 in the upper part of the bulbous piece 4, so as to delimit two strips of material 12*a* and 12*b* which are able to laterally buckle when the rail is subjected to a longitudinal compressive force.

Figure 2:
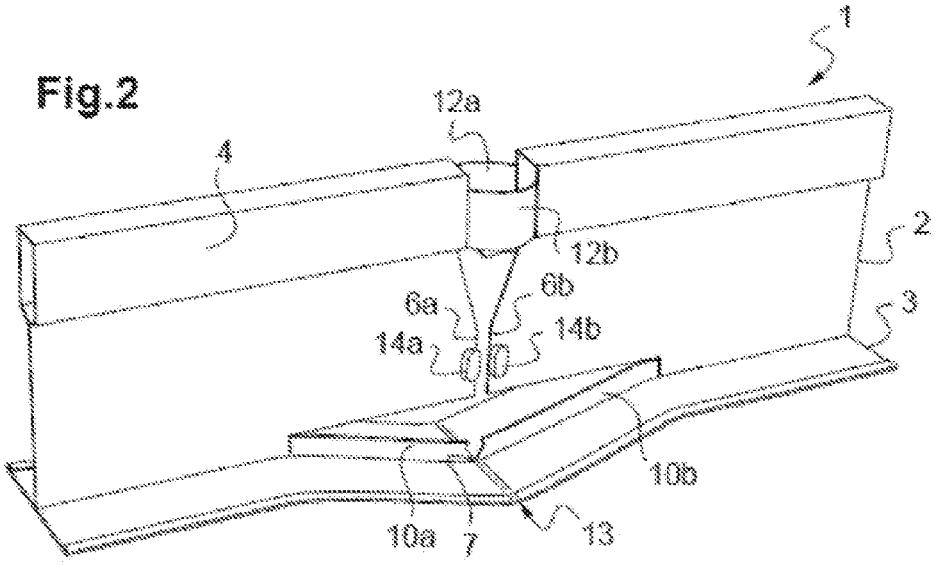
FIG. 2 shows the same perspective view when the rail is subjected to a longitudinal compressive force.
Figure 4:
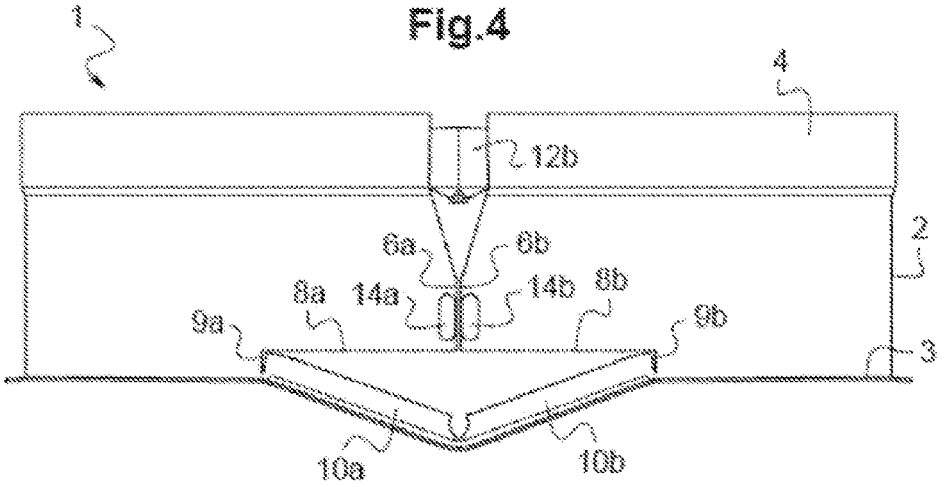
FIG. 4 shows a front view of the rail subjected to a longitudinal compressive force.

FIGS. 2 and 4 illustrate the rail 1 subjected to a longitudinal compressive force. When the absorber is triggered, the base plate 3 and the strips of material 10*a* and 10*b* deflect downwardly from the slits 9*a* and 9*b*, forming a fold line 13 under the notch 7. At the same time, the strips of material 12*a* and 12*b* of the bulbous piece 4 spread apart laterally and the edges 6*a* and 6*b* of the opening 5 come together. The strips of material 12*a* and 12*b* have a length L3.

When the two edges 6*a* and 6*b* come into contact, at a stage of the deformation of the absorber which is controlled by the spacing between the edges, a resistance to compression appears which makes it possible to block the compression of the first absorber triggered and to transfer the subsequent deformations on to another absorber.

Without this resistance, when a first absorber of the rail is triggered, it would constitute a weak zone in terms of compression and would absorb the whole deformation of the rail without another absorber in the rail reaching its triggering threshold.

In order to increase the resistance of the two edges 6*a* and 6*b*, it may be envisaged to add an extra thickness 14*a*, 14*b* along the edges 6*a* and 6*b*.

FIGS. 3 and 4 depict a front view of the same part of rail 1 provided with an absorber. FIG. 3 depicts the distances L1 between the two edges 6*a* and 6*b* and the distance L2 between the distal ends of the horizontal parts 8*a* and 8*b* of the slits. The distance L2 defines the length of the base plate which will deflect under the compressive force.

The distance L3 defines the length of the strips of material 12*a* and 12*b* of the bulbous piece 4 which are able to buckle when the rail is subjected to a longitudinal compressive force.

In order to obtain a good absorption effect while reducing the loss of load-bearing capacity of the rail as much as possible, it is important that the distance L2 is greater than the distance L1. In the example illustrated, L2 is approximately 14 times greater than L1.

The greater the distances L2 and L3, the lower the triggering threshold of the absorber.

The distance L1 does not have an effect on the load-bearing capacity. L1 can be determined based on the desired fire resistance and on the number of absorbers arranged on the same rail.

Unlike the absorbers of the prior art, the slits 8*a*, 9*a* and 8*b*, 9*b* of the absorber according to the present invention make it possible to maximize the load-bearing capacity of the rail and force the two ends of the rail to be held in an aligned plane during the expansion of the rail.

In the example illustrated, if there is an expansion absorber every 60 cm (23.622 inches) the distances are L1=5 mm (0.19685 inch), L2=70 mm (2.75591 inch), L3=10 mm (0.393701 inch).

If there is an expansion absorber every 120 cm (47.2441 inches), the distances are L1=12 mm, L2=70 mm (2.75591 inch), L3=10 mm (0.393701 inch).

Ht is the total height of the profile. Hb is the height of the web. In the example illustrated, Ht is approximately 37 mm (1.45669 inch) and Hb is approximately 25 mm (0.984252 inch).

H1 is the height of the part of the vertical edges 6*a* and 6*b* located above the slits 8*a*, 8*b*. In the example illustrated, H1 is approximately half the height of the web Hb. The larger H1 is, the more the strength of resistance to compression increases, preventing all the expansion being absorbed by a single absorber.

H2 is the height of the strips 10*a* and 10*b*. In the example illustrated, it is a tenth of Hb.

H3 is the height of the strips of material 12*a* and 12*b* of the bulbous piece 4. In the example illustrated, H3 is eight tenths of the height of the bulbous piece 4 (Ht−Hb).

Figure 5:
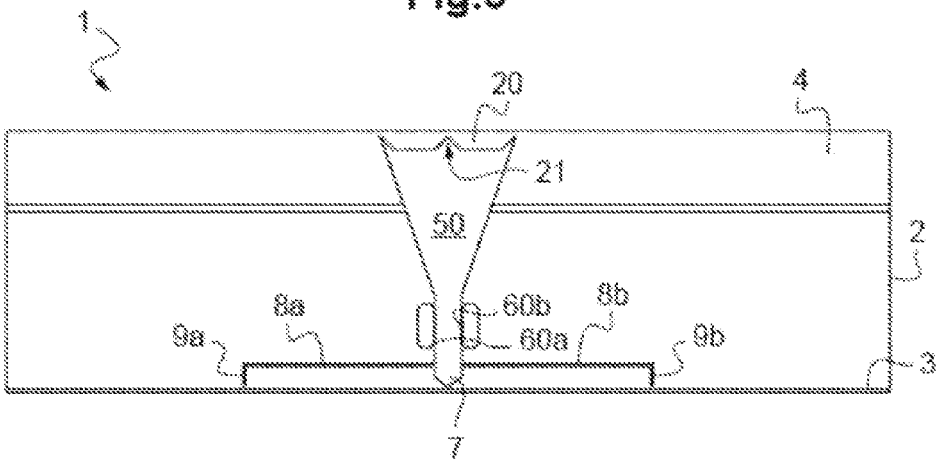
FIG. 5 shows a front view of part of a rail comprising an expansion absorber according to a second embodiment.
Figure 6:
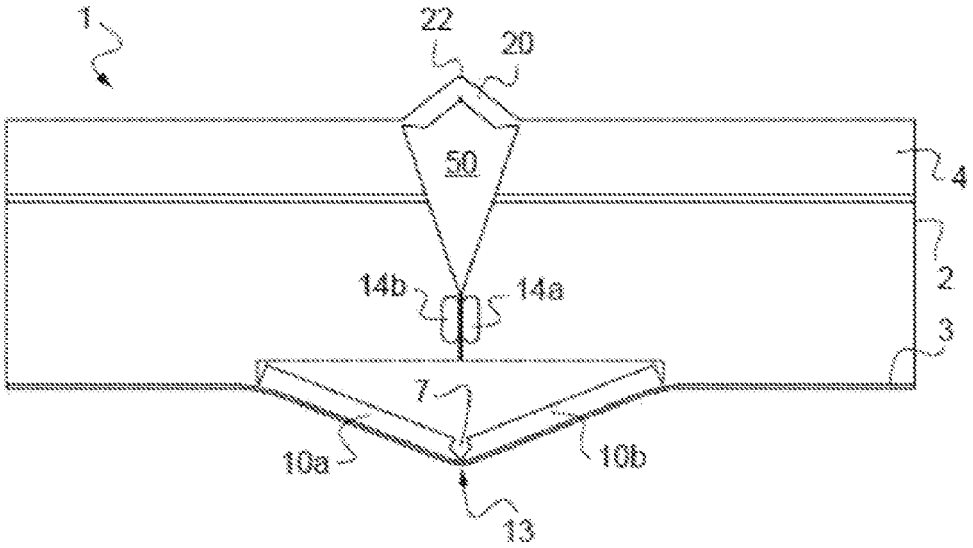
FIG. 6 shows a front view of the same rail as in FIG. 5, subjected to a longitudinal compressive force.

FIGS. 5 and 6 illustrate a second embodiment.

The expansion absorber also consists of a main opening 50 made through the two thicknesses of the web 2. It also extends, at the lower part thereof, to the base plate 3, also delimiting a V-shaped notch 7, but at the upper part thereof, the opening 50 extends substantially to the upper part of the bulbous piece 4, providing only a thin strip of material 20. In order for the strip of material 20 to be able to buckle upward when the rail is subjected to a longitudinal compressive force, it comprises an inverted V-shaped notch 21. This notch 21 thins the strip of material 20 at the central part thereof, to form a fold area 22 which rises when the rail is subjected to a longitudinal compressive force.

The opening 50 also comprises two vertical edges 60*a* and 60*b*, spaced apart by a distance L1.

According to this second embodiment, the expansion absorber also comprises the same slits 8*a*, 9*a*, 8*b*, 9*b* as the absorber illustrated in FIGS. 1 to 4.

The dimensions Ht, Hb, H1, L1, L2 and L3 are substantially the same as for the expansion absorber illustrated in FIGS. 1 to 4.

The invention claimed is:

1. A rail for a panel support forming a suspended ceiling, said rail having an inverted T-shaped cross section and having a total height (Ht), the rail comprising:

a vertical web extending from a lower end to an upper end, horizontal extensions forming a base plate, which is adapted to support panels, which horizontal extensions are arranged at the lower end of the vertical web, a bulbous piece arranged at a top of the vertical web, and at least one expansion absorber;

said expansion absorber comprising a main opening comprising two substantially vertical edges extending into the vertical web, the two substantially vertical edges being spaced apart by a first length (L1) when the rail is not subjected to a longitudinal compressive force, the two substantially vertical edges being aligned so as to abut against one another when the rail is subjected to the longitudinal compressive force;

said main opening extending, at a lower part thereof, as far as an area of material able to form a fold line, said fold line being formed when the rail is subjected to the longitudinal compressive force;

two slits each extending on either side of the main opening over a total second length (L2) greater than the first length (L1), the two slits delimiting, with the base plate, two strips of material which are able to fold, the two substantially vertical edges extending over a first height (H1) representing between 0.3 and 0.8 times a web height (Hb) of the vertical web.

2. The rail according to claim 1, wherein the two slits comprise a horizontal part and a vertical part.

3. The rail according to claim 1, wherein the two slits extend obliquely from a base of the two substantially vertical edges of the main opening toward the area able to form a fold line.

4. The rail according to claim 1, wherein the vertical web comprises an extra thickness which stiffens the two substantially vertical edges of the main opening.

5. The rail according to claim 1, comprising a plurality of expansion absorbers arranged along a length of the rail.

6. The rail according to claim 1, wherein the two substantially vertical edges extend over the first height (H1) representing between 0.4 and 0.8 times the web height (Hb) of the vertical web.

7. The rail according to claim 1, wherein the main opening extends, at the upper part thereof, to a fine strip of material which is able to deform under an effect of the longitudinal compressive force by forming a bridge.

8. The rail according to claim 7, wherein the strip of material which is able to deform comprises a central notch defining a fold line in an upper part of the bulbous piece.

9. The rail according to claim 1, wherein a ratio of the total second length (L2)/first length (L1) is greater than 2.

10. The rail according to claim 9, wherein the ratio of the total second length (L2)/first length (L1) is greater than 4.

11. The rail according to claim 1, wherein a ratio of the first length (L1)/total height (Ht) is between 0.05 and 0.8.

12. The rail according to claim 11, wherein the ratio of the first length (L1)/total height (Ht) is between 0.1 and 0.5.

13. The rail according to claim 1, wherein the two strips of material which are able to fold have a second height (H2), a ratio of the second height (H2)/web height (Hb) being between 0.02 and 0.4.

14. The rail according to claim 13, wherein the ratio of the second height (H2)/web height (Hb) is between 0.05 and 0.2.

15. The rail according to claim 1, wherein:

the upper part of the bulbous piece comprises a cut-out;

the main opening extending, at an upper part thereof, to a segment of intact material present between the main opening and the cut-out of the bulbous piece;

each segment of intact material of the bulbous piece being able to deform laterally under an effect of the longitudinal compressive force.

16. The rail according to claim 15, wherein the segments of material of the bulbous piece which are able to deform have a third length (L3), a ratio of the total second length (L2)/third length (L3) being between 4 and 9.

17. The rail according to claim 16, wherein the ratio of the total second length (L2)/third length (L3) is between 5 and 8.

* * * * *